US011140765B2

(12) United States Patent
Donker et al.

(10) Patent No.: US 11,140,765 B2
(45) Date of Patent: Oct. 5, 2021

(54) RADIATION SOURCE

(71) Applicant: ASML Netherlands B.V., Veldhoven (NL)

(72) Inventors: Rilpho Ludovicus Donker, Eindhoven (NL); Han-Kwang Nienhuys, Utrecht (NL)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 16/649,025

(22) PCT Filed: Aug. 16, 2018

(86) PCT No.: PCT/EP2018/072211
§ 371 (c)(1),
(2) Date: Mar. 19, 2020

(87) PCT Pub. No.: WO2019/057409
PCT Pub. Date: Mar. 28, 2019

(65) Prior Publication Data

US 2020/0296817 A1 Sep. 17, 2020

(30) Foreign Application Priority Data

Sep. 20, 2017 (EP) ..... 17192117

(51) Int. Cl.
*H05G 2/00* (2006.01)

(52) U.S. Cl.
CPC ..... *H05G 2/008* (2013.01); *H05G 2/006* (2013.01)

(58) Field of Classification Search
CPC ..... H05G 2/008; H05G 2/006
(Continued)

(56) References Cited

U.S. PATENT DOCUMENTS 7,411,203 B2 8/2008 Fomenkov et al.
9,823,572 B2 * 11/2017 Nikipelov ..... G01J 1/0418
(Continued)

FOREIGN PATENT DOCUMENTS

TW 2013-19759 A 5/2013
WO WO 2015/071066 A1 5/2015
(Continued)

OTHER PUBLICATIONS

International Search Report and Written Opinion of the International Searching Authority directed to related International Patent Application No. PCT/EP2018/072211, dated Nov. 21, 2018; 12 pages.
(Continued)

*Primary Examiner* — Michael Maskell
(74) *Attorney, Agent, or Firm* — Sterne, Kessler, Goldstein & Fox P.L.L.C.

(57) ABSTRACT

A radiation source comprises: an emitter for emitting a fuel target towards a plasma formation region; a laser system for hitting the target with a laser beam to generating a plasma; a collector for collecting radiation emitted by the plasma; an imaging system configured to capture an image of the target; one or more markers at the collector and within a field of view of the imaging system; and a controller. The controller receives data representative of the image; and controls operation of the radiation source in dependence on the data.

20 Claims, 5 Drawing Sheets

(58) Field of Classification Search
USPC ..... 250/493.1–504 R
See application file for complete search history.

(56) References Cited

U.S. PATENT DOCUMENTS

| | | | | |
|---|---|---|---|---|
| 10,085,334 | B2 | 9/2018 | Yabu | |
| 2010/0171049 | A1 | 7/2010 | Moriya et al. | |
| 2011/0079737 | A1 | 4/2011 | Scholz et al. | |
| 2015/0029478 | A1 | 1/2015 | Schimmel et al. | |
| 2015/0261095 | A1 | 9/2015 | Jansen et al. | |
| 2016/0147161 | A1* | 5/2016 | Nikipelov ..... | G03F 7/70033 355/67 |
| 2017/0280545 | A1 | 9/2017 | Tomita et al. | |

FOREIGN PATENT DOCUMENTS

| | | | | |
|---|---|---|---|---|
| WO | WO2016/146400 | A1 | 9/2016 | |
| WO | WO-2016146400 | A1 * | 9/2016 | ..... H05G 2/005 |
| WO | WO 2016/117118 | A1 | 10/2017 | |
| WO | WO 2017/056324 | A1 | 7/2018 | |

OTHER PUBLICATIONS

International Preliminary Report on Patentability of the International Searching Authority directed to related International Patent Application No. PCT/EP2018/072211, dated Mar. 24, 2020; 8 pages.

* cited by examiner

RADIATION SOURCE

CROSS-REFERENCE TO RELATED APPLICATIONS

This application claims priority of EP application 17192117.4 which was filed on Sep. 20, 2017 and which is incorporated herein in its entirety by reference.

FIELD

The present invention relates to a radiation source for use with a lithographic apparatus.

BACKGROUND

A lithographic apparatus is a machine constructed to apply a desired pattern onto a substrate. A lithographic apparatus can be used, for example, in the manufacture of integrated circuits (ICs). A lithographic apparatus may for example project a pattern from a patterning device (e.g. a mask) onto a layer of radiation-sensitive material (resist) provided on a substrate.

The wavelength of radiation used by a lithographic apparatus to project a pattern onto a substrate determines the minimum size of features which can be formed on that substrate. A lithographic apparatus which uses EUV radiation, being electromagnetic radiation having a wavelength within the range 4-20 nm, may be used to form smaller features on a substrate than a conventional lithographic apparatus (which may for example use electromagnetic radiation with a wavelength of 193 nm).

EUV radiation may be produced using a radiation source arranged to generate an EUV producing plasma. An EUV producing plasma may be generated, for example, by exciting a fuel within the radiation source.

SUMMARY

An aspect of the invention relates to a radiation source, comprising: an emitter configured to emit a fuel target towards a plasma formation region; a laser system configured to hit the fuel target with a laser beam for generating a plasma at the plasma formation region; a collector arranged to collect radiation emitted by the plasma; an imaging system configured to capture an image of the fuel target; a marker at the collector and within a field of view of the imaging system; and a controller configured to receive data representative of the image and to control operation of the radiation source in dependence on the data. The term "collector" is used here interchangeably with the expression "radiation collector". The term "emitter" is used here interchangeably with the expression "fuel emitter". Further the imaging system may include one or more imaging devices, e.g., one or more cameras. The feature of "the marker being at the collector" is to indicate a fixed spatial relationship between the marker and the collector, e.g., by the marker being mounted at the collector, in operational use of the marker. The imaging system may include one or more imaging devices, e.g., the imaging system may comprise one or more cameras.

The image captured of the marker in combination with the fuel target enables to determine a relative spatial relationship between the fuel target and the collector, or at least an attribute of the relative spatial relationship. For example, the controller may be configured to process the data to determine a position of the fuel target relative to the collector. The controller may be configured to control at least one of: a trajectory of the fuel target by adjusting a position and/or orientation of the fuel emitter; a position and/or direction of the laser beam; a position and or orientation of the collector.

In this way, it is possible to optimize the operation of the radiation source. In particular, by modifying, in response to the first image, operation of the at least one component of the radiation source, it may be possible to achieve optimum plasma generation much more quickly than was previously attainable and/or to maintain optimum plasma generation for longer periods of time than were previously attainable.

In an embodiment, the radiation source comprises a second marker at the collector and within the field of view of the imaging system. Thus, an additional attribute of the relative position can be determined.

In an embodiment, the imaging system comprises a first imaging device, a second imaging device, a beam-splitting system and a backlight. The backlight is configured for illuminating the fuel target and the marker with an illumination beam. The beam-splitting system is configured to receive a first part of the illumination beam, affected by the fuel target, and receive a second part of the illumination beam, affected by the marker. The beam-splitting system is further configured to direct the first part to the first imaging device, and the second part to the second imaging device. As the first imaging device and the second imaging device receive different parts of the illumination beam representative of different physical features located at different positions, each individual one of the first imaging device and the second imaging device can independently bring the relevant one of the different physical features in focus.

The radiation source may comprise a second marker at the collector and within the field of view of the imaging system, and the imaging system may then comprise a third imaging device. The backlight my then be configured to also illuminate the second marker with the illumination beam. The beam-splitting system is then configured to receive a third part of the illumination beam affected by the second marker; and direct the third part to the third imaging device.

In a further embodiment, the radiation source comprises a further imaging system configured to capture a further image of the fuel target, and a further marker at the collector and within a further field of view of the further imaging system. The imaging system, mentioned earlier, is configured to capture the image of the fuel target from a pre-determined perspective and the further imaging system is configured to capture the further image of the fuel target from a pre-determined further perspective different from the pre-determined perspective. The controller is configured to receive further data representative of the further image; and control operation of the radiation source in dependence on the further data. The radiation source may include a second further marker at the collector located within the further field of view of the further imaging system.

Accordingly, the radiation source includes two branches: a first branch with the imaging system and a second branch with the further imaging system imaging the fuel target from different perspectives. Thus, more information can be extracted about the relative positional relationship between the fuel target and the collector than by using only a single branch that performs the imaging from a single vantage point. Preferably, the radiation source with the two branches includes an individual pair of markers per individual one of the imaging system and the further imaging system.

The marker may comprise a body substantially opaque to the illumination beam radiation illuminating the body so as to create a shadow represented in the image. Similarly, the second marker may comprise a second body substantially opaque to the illumination beam radiation illuminating the second body so as to create a second shadow represented in the image. Similarly any or each of the further marker and second further may comprise a respective body substantially opaque to a further illumination beam radiation illuminating the respective body so as to create a shadow represented in the further image. The illumination beam is directed such that any or each of the marker and second marker obscures the illumination beam at least partly. The imaging system is arranged such that it can detect the shadow caused by the relevant marker in the path of the illumination beam. For example, the backlight and a relevant one of the imaging devices may be arranged opposite one another and having a line of sight across the collector, with the marker arranged between the backlight and imaging system. Alternatively, the backlight and imaging device may be arranged near one another and a reflector or other suitable optical element may be provided to direct the illumination beam via the reflector or the other optical device to the imaging device. A shadow caused by the illumination beam being incident on a fuel target in the vicinity of the plasma generation region may also be detected by the imaging device.

Any or each of the body and second body may have a respective aperture for letting through part of the illumination beam illuminating the body and second body. Similar considerations may apply to the respective bodies of the further marker and second marker cooperating with the further imaging system of the second branch.

Alternatively, or in combination with body implementations introduced above, any or each of the marker and the second marker may comprise a respective crosshair. As known, a crosshair is a fine wire or thread usually located in a focus of an imaging device. The crosshair is used as a reference for precise viewing or aiming.

As to the beam-splitting system addressed above: the first part of the illumination beam is affected by the presence of the fuel target and the second part of the illumination beam is affected by the marker. The beam-splitting system is used to direct the first part of the illumination beam to the first imaging device and the second part to the second imaging device that is different from the first imaging device. In case the second marker is present at the collector, the third part of the illumination beam affected by the presence of the second marker is directed by the beam-splitting system to a third imaging device, different from the first imaging device and different from the second imaging device. In order for the beam-splitting system to work, the beam-splitting system has to be able to discriminate between the first part, the second part and the third part. That is, the first part has a first characteristic, the second part has a second characteristic, different from the first characteristic, and the beam-splitting system is configured to discriminate between the first part and the second part under control of the first characteristic and the second characteristic. Similarly, in case the second marker is present at the collector and affects the third part of the illumination beam, the third part has a third characteristic different from the first characteristic and the second characteristic.

The first characteristic may include a first wavelength of illumination radiation of the illumination beam, and the second characteristic may include a second wavelength of the illumination radiation different from the first wavelength. If the second marker is present, the third characteristic may include a third wavelength different from the first wavelength and different from the second wavelength. The first characteristic may include a first location of incidence on the beam-splitting system, and the second characteristic may include a second location of incidence on the beam-splitting system, different from the first location of incidence. If the second marker is present at the collector, the third characteristic may include a third location of incidence, different from the first location of incidence and different from the second location of incidence. The first characteristic may include a first polarization of the illumination radiation of the illumination beam, and the second characteristic may include a second polarization of the illumination radiation, different from the first polarization.

When multiple imaging systems are present, it may be possible to determine the position of the radiation collector in six degrees of freedom. For example, it may be possible to determine the position of the collector with reference to a 2D image plane of an imaging device (i.e. relative up/down position and relative left/right position). By cross-referencing the information obtained from images generated by at least two imaging systems which have respective fields of view oriented at a known angle with respect to one another, it may be possible to determine the position of the radiation collector in three dimensions.

In some embodiments, the marker may have a body that comprises a substantially L-shaped or cross-shaped protrusion. The marker may be arranged such that only a part of the marker projects into the field of view of the imaging system. In this way, there is more space available in the field of view to capture an image of the fuel target.

In some embodiments, an aperture may be provided in the protrusion forming the at least one marker. The aperture may allow part of the beam of radiation emitted by the backlight to pass through the marker.

In some embodiments, the at least one marker may be in the form of crosshairs attached to a ring. In this way, the marker may obscure as little as possible of the beam of radiation emitted by the backlight.

In some embodiments, the at least one marker may make a diffraction pattern having an area with a cross-like outline in an image plane of the relevant imaging device. This may facilitate the detection of the marker or the detection of the size of the marker relative to an image plane of the imaging device.

In some embodiments, the at least one marker may comprise an opaque square arranged in the vicinity of the radiation collector and within the field of view of the imaging device.

In some embodiments, the at least one marker may be printed, painted or otherwise affixed onto a substantially transparent plate arranged in a path of a beam of radiation generated by the backlight such that the at least one marker obscures part of the beam of radiation.

In some embodiments, the controller may store information relating to the position of the radiation collector. In some embodiments, the information may comprise information relating to at least one of an initial position of the radiation collector and a relative offset with respect to an initial position of the radiation collector.

Another aspect of the invention relates to a lithographic system comprising a radiation source according to the invention and a lithographic apparatus.

Another aspect of the invention relates to a non-transitory computer readable medium carrying computer readable instructions suitable to cause a computer to: receive a first image of a radiation emitting plasma; generate at least one instruction based on the first image to modify operation of at least one component of a radiation source; and, optionally, process the first image to determine a position of a fuel target with respect to at least one marker.

A further aspect of the invention relates to a combination including an emitter, a collector, an imaging system, and a marker at the collector, the combination being configured for use in the radiation source of the invention Yet another aspect of the invention relates to a collector configured for use in a radiation source according to the invention.

Features described in the context of one aspect or embodiment described above may be used with others of the aspects or embodiments described above.

BRIEF DESCRIPTION OF THE DRAWINGS

Embodiments of the invention will now be described, by way of example only, with reference to the accompanying schematic drawings, in which.

Throughout the drawings, same reference numerals indicate similar or corresponding features.

DETAILED DESCRIPTION

Figure 1:
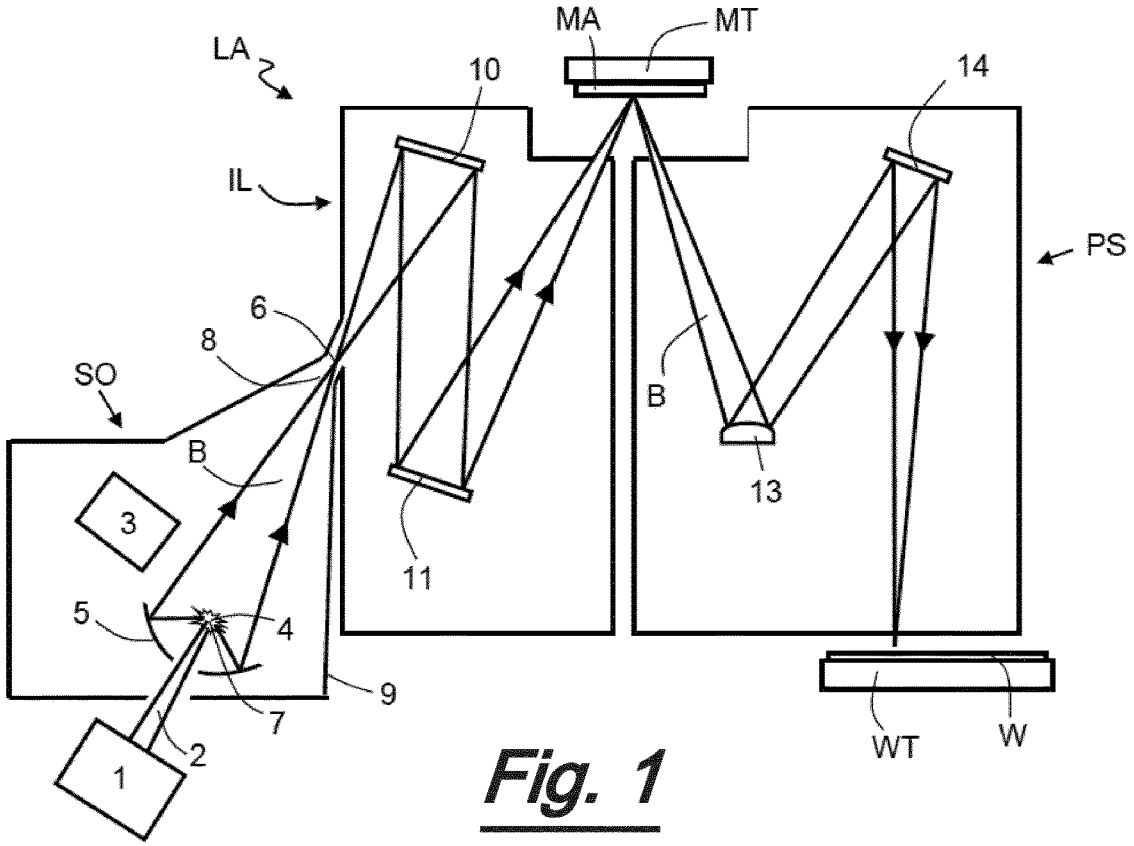
FIG. 1 schematically depicts a lithographic system comprising a lithographic apparatus and a radiation source according to an embodiment of the invention.

FIG. 1 shows a lithographic system including a radiation source according to one embodiment of the invention. The lithographic system comprises a radiation source SO and a lithographic apparatus LA. The radiation source SO is configured to generate an extreme ultraviolet (EUV) radiation beam B. The lithographic apparatus LA comprises an illumination system IL, a support structure MT configured to support a patterning device MA (e.g. a mask), a projection system PS and a substrate table WT configured to support a substrate W. The illumination system IL is configured to condition the radiation beam B before it is incident upon the patterning device MA. The projection system is configured to project the radiation beam B (now patterned by the mask MA) onto the substrate W. The substrate W may include previously formed patterns. Where this is the case, the lithographic apparatus aligns the patterned radiation beam B with a pattern previously formed on the substrate W.

The radiation source SO, illumination system IL, and projection system PS may all be constructed and arranged such that they can be isolated from the external environment. A gas at a pressure below atmospheric pressure (e.g. hydrogen) may be provided in the radiation source SO. A vacuum may be provided in illumination system IL and/or the projection system PS. A small amount of gas (e.g. hydrogen) at a pressure well below atmospheric pressure may be provided in the illumination system IL and/or the projection system PS.

Figure 2:
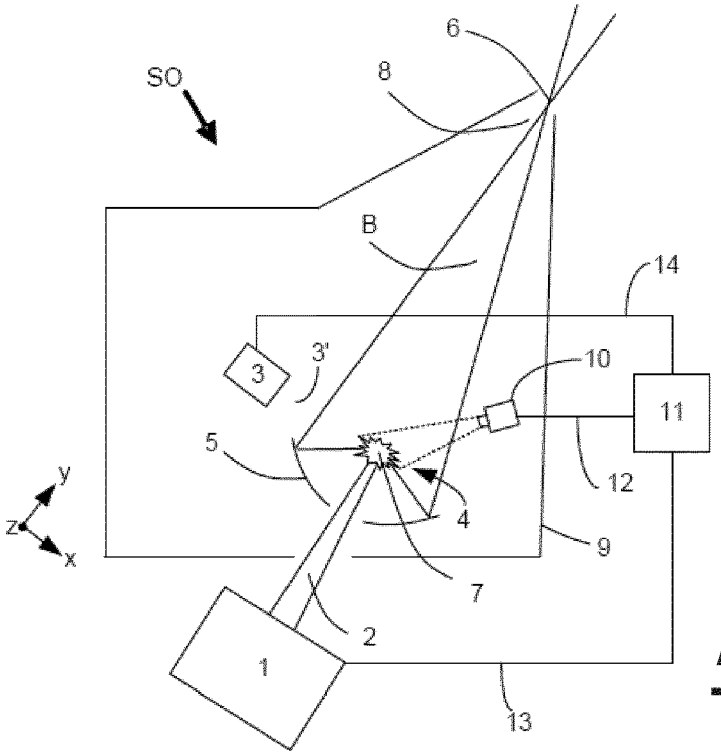
FIG. 2 schematically depicts an example radiation source according to an embodiment of the invention.

An example of the radiation source SO is shown in FIG. 2. The radiation source SO shown in FIG. 2 is of a type which may be referred to as a laser produced plasma (LPP) source. A laser 1, which may for example include a $CO_2$ laser, is arranged to deposit energy via a laser beam 2 into a fuel, such as tin (Sn) which is provided from a fuel emitter 3. The laser may be, or may operate in the fashion of, a pulsed, continuous wave or quasi-continuous wave laser. The trajectory of fuel emitted from the fuel emitter 3 is parallel to an x-axis marked on FIG. 2. The laser beam 2 propagates in a direction parallel to a y-axis, which is perpendicular to the x-axis. A z-axis is perpendicular to both the x-axis and the y-axis and extends generally into (or out of) the plane of the page.

Although tin is referred to in the following description, any suitable fuel may be used. The fuel may for example be in liquid form, and may for example be a metal or alloy. The fuel emitter 3 may comprise a nozzle configured to direct tin, e.g. in the form of discrete fuel targets along a trajectory towards a plasma formation region 4. Throughout the remainder of the description, references to "fuel", "fuel target" or "fuel droplet" are to be understood as referring to the fuel emitted by the fuel emitter 3. The laser beam 2 is incident upon the tin at the plasma formation region 4. The deposition of laser energy into the tin creates a plasma 7 at the plasma formation region 4. Radiation, including EUV radiation, is emitted from the plasma 7 during de-excitation and recombination of ions and electrons of the plasma.

The EUV radiation is collected and focused by a near normal-incidence radiation collector 5 (sometimes referred to more generally as a normal-incidence radiation collector). The collector 5 may have a multilayer structure which is arranged to reflect EUV radiation (e.g. EUV radiation having a desired wavelength such as 13.5 nm). The collector 5 may have an ellipsoidal configuration, having two focal points. A first focal point may be at the plasma formation region 4, and a second focal point may be at an intermediate focus 6, as discussed below.

The laser 1 may be located at a relatively long distance from the radiation source SO. Where this is the case, the laser beam 2 may be passed from the laser 1 to the radiation source SO with the aid of a beam delivery system (not shown) comprising, for example, suitable directing minors and/or a beam expander, and/or other optics. The laser 1 and the radiation source SO may together be considered to be a radiation system.

Radiation that is reflected by the collector 5 forms a radiation beam B. The radiation beam B is focused at point 6 to form an image of the plasma formation region 4, which acts as a virtual radiation source for the illumination system IL. The point 6 at which the radiation beam B is focused may be referred to as the intermediate focus. The radiation source SO is arranged such that the intermediate focus 6 is located at or near to an opening 8 in an enclosing structure 9 of the radiation source.

The radiation beam B passes from the radiation source SO into the illumination system IL, which is configured to condition the radiation beam. The illumination system IL may include a facetted field-minor device 10 and a facetted pupil-mirror device 11. The faceted field-mirror device 10 and faceted pupil-mirror device 11 together provide the radiation beam B with a desired cross-sectional shape and a desired distribution of the intensity of the radiation beam in the beam's cross-section. The radiation beam B passes from the illumination system IL and is incident upon the patterning device MA held by the support structure MT. The patterning device MA reflects and patterns the radiation beam B. The illumination system IL may include other minors or devices in addition to or instead of the faceted field-mirror device 10 and faceted pupil-mirror device 11.

Following reflection from the patterning device MA the patterned radiation beam B enters the projection system PS. The projection system comprises a plurality of minors which are configured to project the radiation beam B onto a substrate W held by the substrate table WT. The projection system PS may apply a reduction factor to the radiation beam, forming an image with features that are smaller than corresponding features on the patterning device MA. A reduction factor of 4 may for example be applied. Although the projection system PS has two mirrors in FIG. 1, the projection system may include any number of mirrors (e.g. six mirrors).

The radiation source SO may include components which are not illustrated in FIG. 2. For example, a spectral filter may be provided in the radiation source. The spectral filter may be substantially transmissive for EUV radiation but substantially blocking for other wavelengths of radiation such as infrared radiation.

The radiation source SO (or radiation system) further comprises an imaging system to obtain images of fuel targets in the plasma formation region 4 or, more particularly, to obtain images of shadows of the fuel targets. The imaging system may detect light diffracted from the edges of the fuel targets. References to images of the fuel targets in the following text should be understood also to refer to images of shadows of the fuel targets or diffraction patterns caused by the fuel targets.

The imaging device may comprise a photodetector such as a CCD array or a CMOS sensor, but it will be appreciated that any imaging device suitable for obtaining images of the fuel targets may be used. It will be appreciated that the imaging device may comprise optical components, e.g., one or more lenses in addition to a photodetector. For example, the imaging device may include a camera 10, i.e., a combination of a photosensor (or: photodetector) and one or more lenses. The optical components may be selected so that the photosensor or camera 10 obtains near-field images and/or far-field images. The camera 10 may be positioned within the radiation source SO at any appropriate location from which the camera has a line of sight to the plasma formation region 4 and one or more markers (not shown in FIG. 2) provided on the collector 5 (as discussed below with reference to FIG. 3). It may be necessary, however, to position the camera 10 away from the propagation path of the laser beam 2 and from the trajectory of the fuel emitted from the fuel emitter 3 so as to avoid damage to the camera 10. The camera 10 is arranged to provide images of the fuel targets to a controller 11 via a connection 12. The connection 12 is shown as a wired connection, though it will be appreciated that the connection 12 (and other connections referred to herein) may be implemented as either a wired connection or a wireless connection or a combination thereof.

Figure 3:
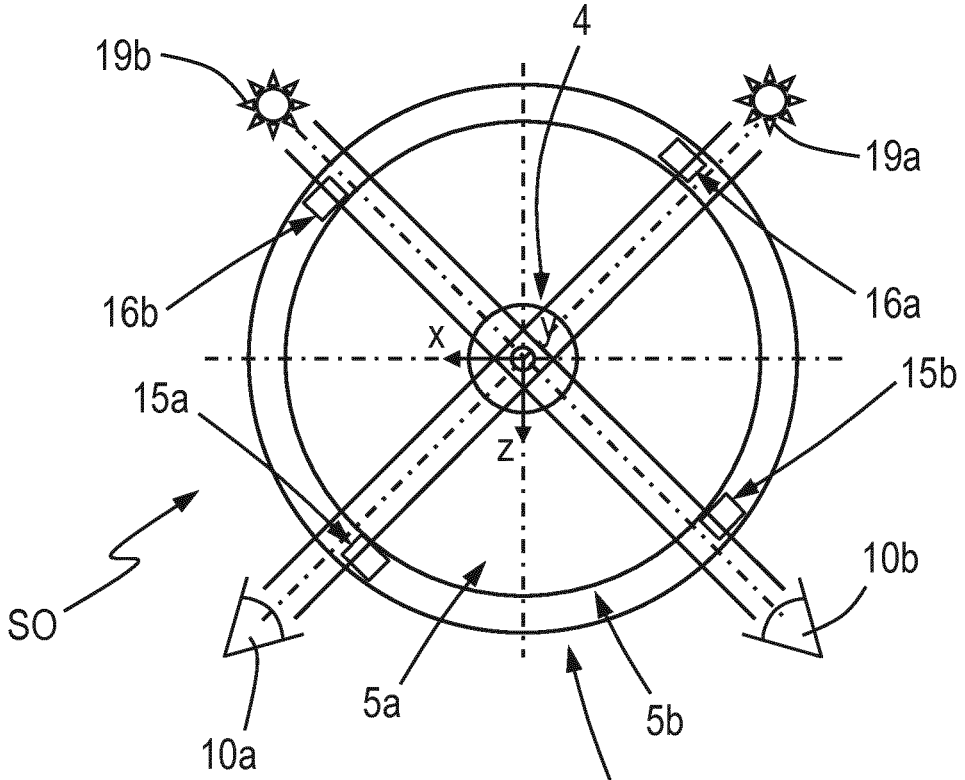
FIG. 3 schematically depicts a plan view of an example radiation source according to an embodiment of the invention.

FIG. 3 shows a schematic plan view of an exemplary embodiment of components of a radiation source SO. The components of the radiation source SO depicted in FIG. 3 comprise a radiation collector 5. The radiation collector 5 comprises a first portion 5*a* and a second portion 5*b*. The first portion 5*a* may be an inner portion of the radiation collector 5. The first portion 5*a* may be configured to reflect EUV radiation generated by the plasma 7. The plasma formation region 4 may be located in the vicinity of the first portion 5*a* of the radiation collector 5. As specified earlier, one of the focal points of an ellipsoidal collector lies in the plasma formation region.

The second portion 5*b* of the radiation collector 5 may physically be an outer portion of the radiation collector 5. The second portion 5*b* may generally be not arranged to reflect EUV radiation towards the lithographic apparatus. For example, the second portion 5*b* may be less reflective for EUV radiation than the first portion 5*a* or may be non-reflective. The second portion 5*b* (also referred to below as "outer portion") may be provided with at least one marker. In the exemplary embodiment shown in FIG. 3, the second portion is provided with four markers 15*a*, 16*a*, 15*b*, 16*b*, which will be discussed in more detail below.

The radiation source SO comprises at least one imaging system. In the diagram of FIG. 3, the radiation source SO comprises an imaging system and a further imaging system, each whereof comprises at least one imaging device. In the exemplary embodiment of FIG. 3, the imaging system comprises a first camera 10*a* and the further imaging system comprises a second camera 10*b* respectively associated with a first backlight 19*a* and a second backlight 19*b*. The cameras 10*a*, 10*b* may be arranged, as depicted in FIG. 3, such that a viewing axis of the first camera 10*a* is substantially perpendicular with respect to a viewing axis of the second camera 10*b*. However, it is also possible for the cameras to be arranged such that the angle between the viewing axes differs from 90 degrees. For completeness, the viewing axis of the camera 10*a* need not be intersecting the viewing axis of the camera 10*b*. That is, the viewing axes of the cameras 10*a*, 10*b* need not span a plane. In that case, the angle between the viewing axes is meant to indicate the angle between the perpendicular projections of the viewing axes onto a plane perpendicular to the optical axis of the collector 5.

Further, it will be appreciated that, in other embodiments, the cameras 10*a*, 10*b* may be positioned elsewhere within the radiation source SO. For example, in some embodiments, suitable optical delivery systems (such as mirrors, lenses, etc.) may be provided to direct illumination beams of electromagnetic radiation from the backlights 19*a*, 19*b* to the cameras 10*a*, 10*b* positioned at locations other than the ones shown in FIG. 3. In some embodiments, the cameras 10*a*, 10*b* may be positioned near their respective backlights 19*a*, 19*b* instead of opposite one another as shown in FIG. 3. Such an embodiment may occupy less space than in the depicted example. Where there are two distinct viewing axes, it is possible for the imaging devices to cover six degrees of freedom with respect to the radiation collector 5. The respective viewing axes of the first and second cameras 10*a*, 10*b* are directed towards the plasma formation region 4 in the vicinity of the first portion 5*a* of the radiation collector 5. The first backlight 19*a* is associated with the first camera 10*a* and the second backlight 19*b* is associated with the second camera 10*b*, forming a camera-backlight group in each case. In each case, a respective backlight 19*a*, 19*b* may be positioned opposite its associated camera 10*a*, 10*b*, with the first portion 5*a* of the radiation collector 5 arranged between them, when looking at the collector along the collector's optical axis (y-axis). Alternatively, a respective backlight 19*a*, 19*b* may be arranged in the vicinity of (i.e., near to) its associated camera 10*a*, 10*b* such that the radiation collector 5 is not arranged between the camera 10*a*, 10*b* and the backlight 19*a*, 19*b*, when looking at the collector along the collector's optical axis. In the latter case, a reflector (for example a mirror or a retroreflector) may be arranged so as to be able to direct the illumination beams of electromagnetic radiation emitted from the backlight 19*a*, 19*b* towards the associated camera 10*a*, 10*b*. The path of the electromagnetic radiation from the backlight to the associated camera via the reflector crosses a region traversed by fuel targets emitted the fuel emitter 3. The respective backlights 19*a*, 19*b* may facilitate image capture by the respective cameras 10*a*, 10*b* of fuel targets which are emitted towards the plasma formation region 4. The backlights 19*a*, 19*b* may take any appropriate form. In some embodiments, the backlights 19*a*, 19*b* may emit electromagnetic radiation with a wavelength of approximately 900 nm. It will be appreciated, however, that other wavelengths may be used.

At least one marker is arranged at the outer portion 5*b* of the radiation collector 5 between a respective camera 10*a*, 10*b* and associated backlight 19*a*, 19*b*, so as to be at least partly captured by the respective camera 10*a*, 10*b*. In embodiments where the camera 10*a*, 10*b* and associated backlight 19*a*, 19*b* are arranged near one another, the at least one marker may be arranged in the path of the electromagnetic radiation from the backlight 19*a*, 19*b* to the associated camera 10*a*, 10*b*.

The marker may comprise a body substantially opaque to the illumination beam radiation illuminating the body so as to create a shadow, represented in the image.

In the embodiment shown in FIG. 3, there are two markers 15*a*, 16*a* located between the camera 10*a*, and backlight 19*a*, and two markers 15*b*, 16*b* located between the camera 10*b* and the backlight 19*b* of each camera-backlight group. The markers may be implemented so as to protrude from the outer portion 5*b* of the radiation collector 5 substantially in a direction parallel to the y-axis (which extends generally into (or out of) the plane of the page in FIG. 3) such that at least part of each marker 15*a*, 16*a*, is present in a field of view of the associated camera 10*a*, and at least part of each marker 15*b*, 16*b* is present in a field of view of the associated camera 10*b*. For example, two markers 15*a* and 16*a* are present in the field of view of the first camera 10*a*. One marker 15*a* is located closer to the first camera 10*a* and the other marker 16*a*, is located closer to the first backlight 19*a*. Correspondingly, two markers 15*b*, 16*b* can be detected in the field of view of the second camera 10*b*. Again, in this case, one marker 15*b* is located closer to the second camera 10*b* and the other marker 16*b* is located closer to the second backlight 19*b*. Within each pair of markers 15*a*, 16*a* and 15*b*, 16*b* one of the markers may be taller than the other, or may have otherwise physical characteristics different from those of the other, to aid detection of each of the pair of markers by the cameras 10*a*, 10*b*. For example, depending upon the relative positioning of the backlights 19*a*, 19*b*, the markers 15*a*, 16*a*, 15*b*, 16*b* and the cameras 10*a*, 10*b*, various markers of differing shapes or sizes may be used to prevent one marker within a pair from completely occluding the other marker of the pair or simply to position each marker within a pair at a different place within the field of view of the associated camera. In the example depicted in FIG. 4, the marker 16*a* is taller than the marker 15*a*, with the marker 16*a* occupying a top-left-most portion of the field of view of the camera 10*a* and the marker 15*a* occupying a bottom-right-most portion of the field of view of the camera 10*a*.

In operational use of the source SO, the markers 15*a*, 16*a*, 15*b*, 16*b* are each arranged at fixed locations with respect to the radiation collector 5. The location and dimensions or other physical characteristics of each marker 15*a*, 16*a*, 15*b*, 16*b* are known in advance. In this way, it is possible to calculate the position of the radiation collector 5 with respect to the fuel targets in the plasma formation region 4 by processing images generated by a respective camera 10*a*, 10*b*. The determination of fuel target positions with respect to the collector 5 will be explained in more detail below with reference to FIGS. 4 and 5. For completeness, the term "calculate" as used herein may indicate running a mathematical algorithm, consulting a pre-determined look-up table that matches the pixels of the images captured to the relative position of the collector 5 and the fuel targets, etc., or a combination thereof.

Figure 4:
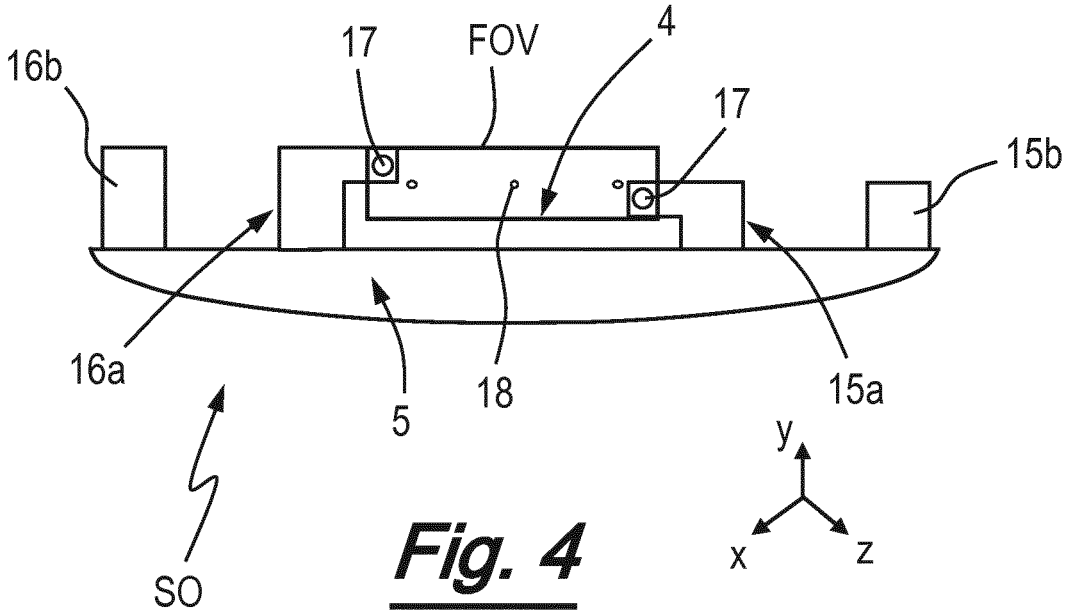
FIG. 4 schematically depicts a lateral view of the radiation source from FIG. 3.
Figure 5:
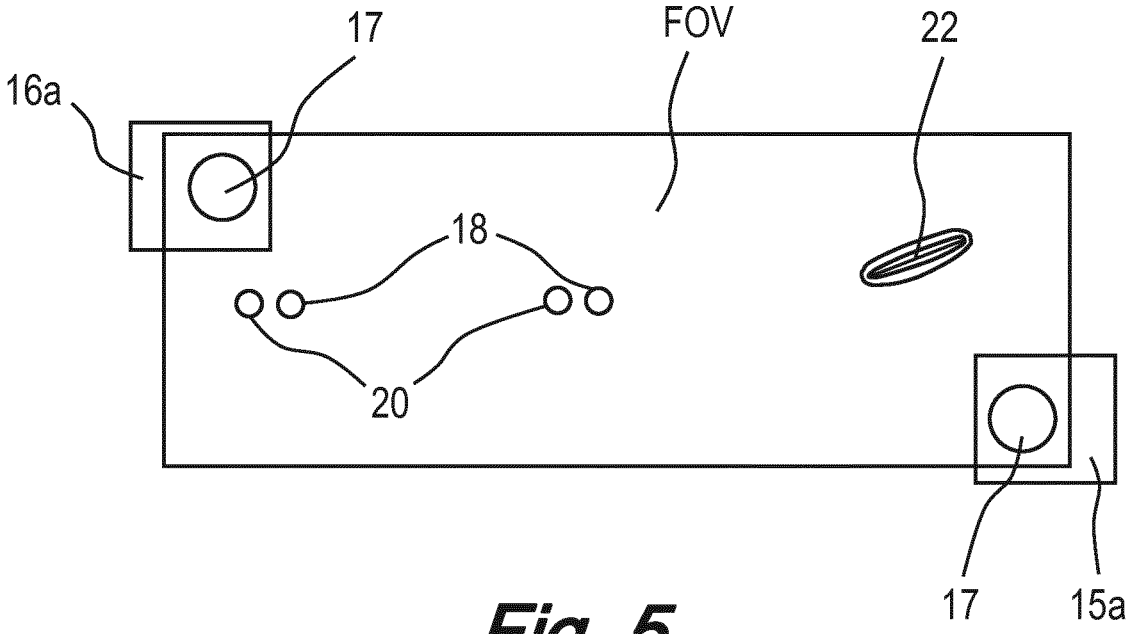
FIG. 5 schematically depicts a detail from FIG. 4.

FIG. 4 shows a lateral view of the exemplary embodiment of the radiation source SO from FIG. 3. A feature labeled FOV depicted above the collector 5 in the center of FIG. 4 represents the field of view of the first camera 10*a*. FIG. 5 shows a more detailed view of the field of view FOV of the first camera 10*a* from FIG. 4.

It will be appreciated that, in this embodiment, the first and second cameras 10*a*, 10*b* function in generally the same way, although it will be appreciated that the cameras may be different in configuration and/or may capture images differently. Similarly, the backlights 19*a*, 19*b* may have different configurations and or emit electromagnetic radiation having different characteristics. For the avoidance of repetition, therefore, any description relating to functionality of the first camera 10*a*, of the first backlight 19*a* and of the associated markers 15*a*, 16*a*, should be understood as being also applicable to the second camera 10*b*, second backlight 19*b* and associated markers 15*b*, 16*b*.

It can be seen in FIGS. 4 and 5 that the markers 15*a* and 16*a* partially project into the field of view FOV of the first camera 10*a*. In the embodiment of FIGS. 4 and 5, the markers are L-shaped protrusions which extend from the outer portion 5*b* of the radiation collector 5. However, in other embodiments, the markers may be in a different form. For example, the markers may be protrusions having a different shape. For example, the markers may be substantially rectangular or substantially cross-shaped. The markers may each have the same shape or one or more of the markers may have a different shape from one or more others of the markers. At least part of each marker associated with a particular viewing axis (e.g. as defined by a particular camera 10*a*, 10*b*) is present in the field of view of the associated camera 10*a*, 10*b*.

In some embodiments, one or more of the markers may be provided with one or more apertures 17 arranged in a part of the relevant marker which is present in the field of view of the associated camera. Such an aperture 17 may be provided with a lens of known characteristics. In this way, it may be possible to obtain more information from an image captured by the camera.

As explained above, the dimensions, or relevant other characteristics, of the markers 15*a*, 16*a* and their respective locations relative to the radiation collector 5 are known. The controller 11 receives data representative of a first image from the camera 10*a*. If there is a fuel droplet present in the field of view of the camera 10*a* at the moment of capturing the first image, the first image may comprise data from which can be determined information relating to at least one property (e.g., position, shape) of the fuel droplet provided to the plasma formation region 4 by the fuel emitter 3. The diagram of FIG. 5 shows two fuel droplets 18 being present in the field of view of the camera 10*a*. Alternatively or in addition, the first image may comprise data, from which information can be extracted relating to at least one property of a laser beam provided to the plasma formation region 4.

Alternatively or in addition, the first image may comprise data representative of information relating to a plasma 7 formed in the plasma formation region 4. In the detailed view shown in FIG. 5, fuel targets 18 and shadows 20 of the fuel targets 18 are depicted in the field of view FOV of the camera 10*a*. In practice, it is the shadows 20 of the fuel targets 18 (caused by the fuel targets 18 interrupting the path of the electromagnetic radiation emitted by the backlights) which are detected by the cameras 10*a*, 10*b*. Also visible in the field of view FOV of FIG. 5 is a shadow of a flattened fuel target 22. This may occur when a pre-pulse laser beam (not shown) is incident on the fuel target, before the laser beam (main pulse) is incident on the fuel target and plasma is generated.

The data representative of the first image received at the controller 11 also comprises information relating to the location of the markers 15*a*, 16*a*. In particular, the dimensions or other characteristics of the markers 15*a*, 16*a* are known, the dimensions of the field of view FOV of the camera 10*a* are known, the initial locations of the markers within the field of view FOV (i.e., from a calibration measurement) are known and the angle between the viewing axes of the cameras 10*a*, 10*b* is known. Therefore, the controller 11 may calculate (based on images obtained from the camera 10*a*) at least one of: the position of the radiation collector, a trajectory of fuel emitted by the fuel emitter, and a position (or trajectory) of the laser beam.

The controller 11 may then generate an instruction to modify operation of at least one component of the radiation source SO in order to improve at least one aspect of the performance thereof. For example, the instruction may be suitable for adjusting the trajectory of fuel emitted by the fuel emitter in order to provide improved plasma generation and/or to provide an improved location of the plasma generation relative to the focus of the collector 5. In this way, more EUV radiation generated by the plasma 7 may be collected and provided to other components of the lithographic system. Additionally or alternatively, the instructions may be suitable for adjusting a rate of fuel emitted by the fuel emitter, a quantity of fuel emitted by the fuel emitter, and/or a characteristic of the laser beam (such as, for example, a power, a trajectory, etc.).

It may be desirable to remove the radiation collector 5 from the source SO, e.g., for cleaning purposes or for being replaced by another collector. The controller 11 may store information relating to the position of the radiation collector 5 to be removed so that an offset with respect to an initial position of the radiation collector 5, upon being reinstalled, is known. That is, the controller 11 may store a difference between an initial position of the reinstalled radiation collector 5 and a final position (prior to removal) of the radiation collector 5. The stored offset may be used to optimize a position of the reinstalled radiation collector 5. For example, in the event that the initial position of the reinstalled radiation collector 5 is incorrect, it may be possible to detect and resolve this more rapidly. It may also be possible to use the stored offset or a known or calculated offset between the initial position of the reinstalled radiation collector 5 and an initial position of the radiation collector 5 prior to removal to calculate, or otherwise determine, a revised optimum plasma position, which may be different to a previously calculated, or otherwise determined, optimum plasma position. Similar considerations may apply when replacing the removed collector by another collector.

In another embodiment, each of the imaging system and the further imaging system may include two additional cameras for each viewing axis. That is, the imaging system may comprise a second camera and a third camera, and the further imaging system may comprise a further second camera and a further third camera. The cameras and backlight provided for each viewing axis (i.e., for each imaging system) form a camera-backlight group, now comprising three cameras for that viewing axis. The second camera of the imaging system may be focused on the marker 15*a* nearest to the second camera, and the further second camera of the further imaging system may be focused on the marker 15*b* nearest to the further second camera. The third camera of the imaging system may be focused on the marker 16*a* furthest from the third camera, and the further third camera may be focused on the marker 16*b* furthest from the further third camera. The imaging system may then include a beam-splitting system and the further imaging system may then include a further beam-splitting system. Such a beam-splitting system of the imaging system may then receive a first part of the illumination beam, affected by the presence of the fuel target, a second part of the illumination beam affected by the presence of the marker 15*a*, and a third part of the illumination beam affected by the presence of the marker 16*a*. The beam-splitting system directs the first part to the first camera, the second part to the second camera and the third part to the third camera. A similar description, mutatis mutandis, may apply to the further imaging system having the further camera, the further second camera, the further third camera and the further beam-splitting system. the beam-splitting system may include two beam splitters. For the viewing axis of the imaging system , in-focus images of each of the markers 15*a*, 16*a* and of the shadows of the fuel targets can be obtained. Similarly, for the viewing axis of the further imaging system, in-focus images of each of the markers 15*b*, 16*b* and of other shadows of the fuel targets can be obtained. In this way, the relative position of the fuel targets with respect to the collector 5 can be established with higher accuracy than if a single camera were used per individual one of the imaging system and the further imaging system in order to image markers 15*a*, 16*a*, 15*b*, 16*b* and the fuel target. An embodiment using three cameras in the imaging system will be described in more detail below with reference to FIG. 6. The description of the embodiment of FIG. 6 may also apply, mutatis mutandis, to the further imaging system.

Figure 6:
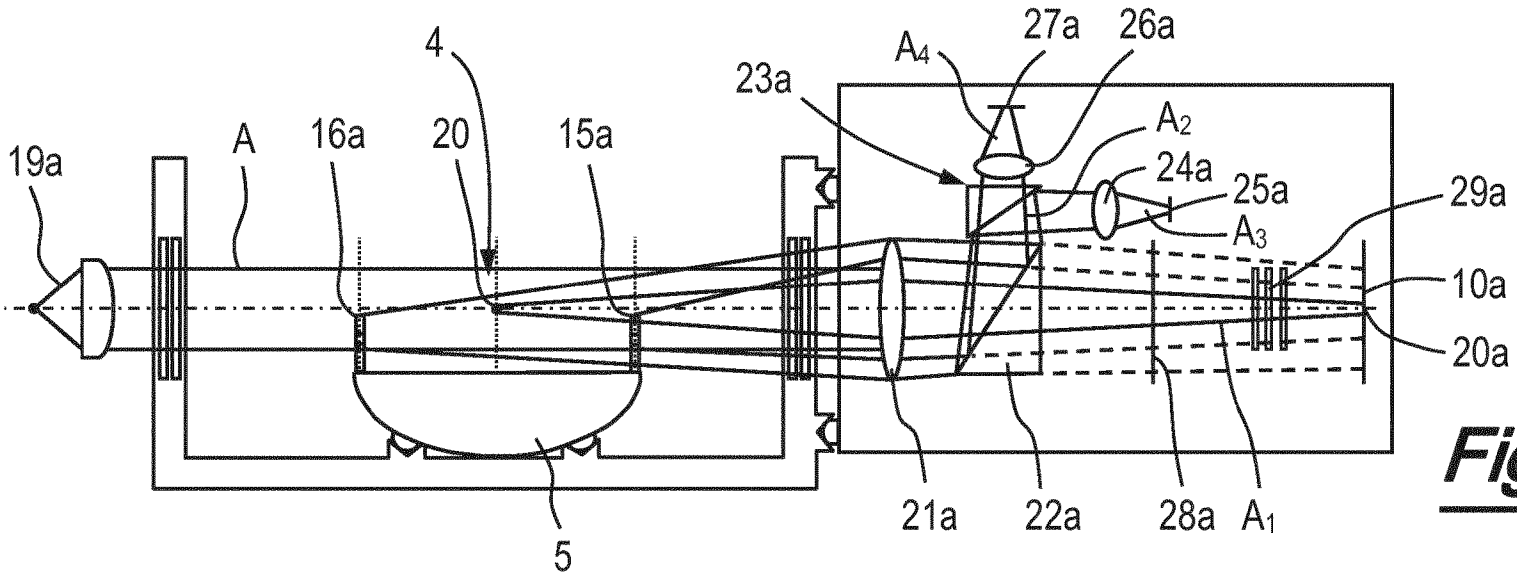
FIG. 6 schematically depicts a lateral view of an embodiment of parts of a radiation system.

FIG. 6 shows a schematic lateral view of parts of an embodiment of the radiation source SO. The collector 5 with markers 15*a* and 16*a* is shown towards the middle of the path of illumination beam A from the backlight 19*a* to the first camera 10*a*. In the diagram, the first camera 10*a* is represented by the plane of its photodetector (or: photosensor). A first beam splitter 22*a* is provided between the collector 5 and the first camera 10*a*. A first lens 21*a* may optionally be provided upstream of the camera 10*a* in order to focus the image to be captured by the camera 10*a*. Alternatively or in addition, a minor (such as a fold minor-not shown) may be provided upstream of the camera 10*a* in order to further focus the image to be captured by the camera 10*a*. It is remarked in this respect that the feature "camera 10*a*" may just include a photodetector or photosensor. The first lens 21*a* and the fold mirror may then serve to properly focus the image projected onto the photosensor. In some embodiments, one or more optical filters (not shown) and/or a polarizer (not shown) may also optionally be provided upstream of the camera 10*a*.

A fuel target is present in the plasma formation region 4 in the vicinity of the collector 5. The fuel target causes a shadow 20 to be formed in the illumination beam A. The beam A is focused by the first lens 21*a* and a part $A_1$ of the beam A is directed through the first beam splitter 22*a* towards the camera 10*a*. In this way, the shadow 20 of the droplet can be detected by the camera 10*a* at location 20*a*.

The remaining part $A_2$ of the beam A is diverted by the first beam splitter 22*a* and may be directed to a second beam splitter 23*a*. Here, the beam $A_2$ may be divided with a part $A_3$ of the beam $A_2$ being directed to a second camera 25*a* and another part $A_4$ of the beam $A_2$ passing through the second beam splitter 23*a* to a third camera 27*a*. In the diagram, the second camera 25*a* and the third camera 27*a* are represented by their respective planes of their photodetectors.

The second camera 25*a* may be provided to obtain an in-focus image of the marker 15*a* nearest to the cameras along the viewing axis. The third camera 27*a* may be provided to obtain an in-focus image of the marker 16*a* furthest from the cameras along the viewing axis. Further lenses 24*a* and 26*a* may be optionally provided in order to further focus the images captured by the cameras 25*a* and 27*a*. As remarked above, in this respect the features "second camera 25*a*" and "third camera 27*a*" may each just include a further photodetector or further photosensor. The further lenses 24*a* and 26*a* may then serve to properly focus the images projected onto the respective photosensors.

In an alternative embodiment of the imaging system, only two cameras and one beam splitter may be provided, namely the first camera 10*a* and another camera. In this case, the other camera may focus, for example, on the shadow of the droplet and on the marker 16*a*, 16*b* furthest from the cameras. This exemplary embodiment is schematically illustrated in FIG. 7.

Figure 7:
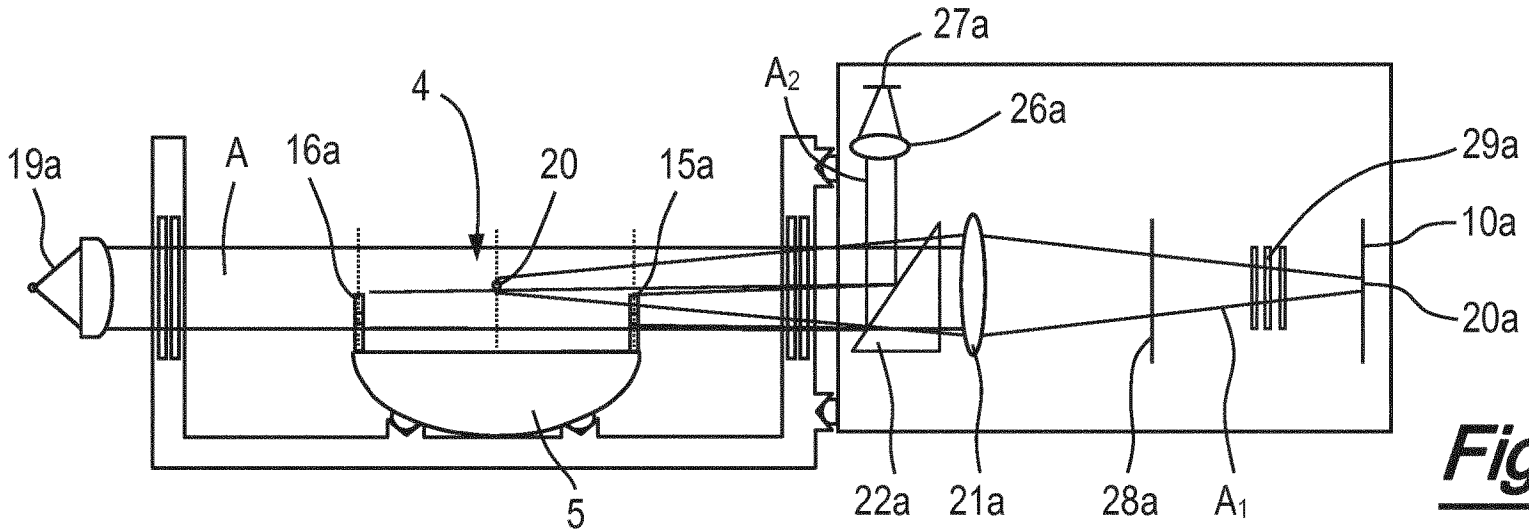
FIG. 7 schematically depicts a lateral view of another embodiment of parts of a radiation system.

The embodiment illustrated in FIG. 7 generally differs from that illustrated in FIG. 6 only in that only two cameras 10*a* and 27*a* are provided in the imaging system. As a result, only one beam splitter 22*a* is provided in the embodiment illustrated in FIG. 7. As explained above with reference to FIG. 6, a part $A_1$ of the beam A is directed through the beam splitter 22*a* towards the camera 10*a*. In this way, the shadow 20 of the droplet can be detected by the camera 10*a* at location 20*a*. The remaining part $A_2$ of the beam A is diverted by the first beam splitter 22*a* and may pass through an optional lens 26*a*. The remaining part $A_2$ of the beam A is incident on the camera 27*a*. Thus, the images of the droplet, of the marker 15*a* and of the marker 16*a* may be processed at different foci. For example, an image capturing the droplet and the marker 15*a* may be processed via camera 10*a*, and an image capturing the marker 16*a* may be processed by camera 27*a*. As another example, an image capturing the droplet and the marker 15*a* may be processed via camera 10*a*, and an image capturing the droplet and the marker 16*a* may be processed by camera 27*a*.

In an alternative embodiment, the backlight may provide two beams having different wavelengths, or having different polarization. Preferably, the backlight may provide three beams having different wavelengths, with each different one of the beams aimed at a different feature: one aimed at the fuel targets, one at the marker 15*a* and another one at the marker 16*a*. In this embodiment, the beam splitters 22*a* and 23*a* are dichroic (i.e. selectively transmitting and reflecting different wavelengths). The beam splitters may be chosen such that they transmit one or more of the plurality of the two or three beams and reflect one or more other ones of the plurality of beams.

In particular, where two illumination beams of different wavelengths are provided for the imaging system, a first dichroic beam splitter 22*a* is provided which allows one of the wavelengths to pass through to be received at the first camera 10*a* and reflects the other one of the wavelengths to be received at the camera 27*a*. As a result, it may be possible to receive in-focus images at least of the shadow 20 of the fuel target and one of the markers 15*a* or 16*a*.

Alternatively, where three beams of different wavelengths are provided by the backlight, as per FIG. 6, a first dichroic beam splitter 22*a* is provided which allows one of the wavelengths to pass through to be received at the first camera 10*a* and reflects the other two wavelengths towards a second dichroic beam splitter 23*a*. The second beam splitter 23*a* is selected such that it allows one of the two wavelengths reflected by the first beam splitter 22*a* to pass through to be received at the second camera 25*a* and reflects the other wavelength reflected by the first beam splitter 22*a* to be received at the third camera 27*a*. As a result, it may be possible to receive in-focus images of each of the two markers 15*a*, 16*a* and of the shadow 20 of the fuel target.

In some embodiments, it may be desirable to use markers that provide as little obscuration as possible of the beams from the backlights 19*a* and 19*b*. For example, the markers may be in the form of, one or two crosshairs attached to a ring. The ring may be arranged such that it does not obscure the backlight beam at all or such that it obscures the backlight beam only to a small extent. In this way, it may be possible to avoid diffracted light from a large obscuration overlapping with the tiny diffraction pattern from the fuel target and to avoid blurring the image of the fuel target.

Figure 8A:
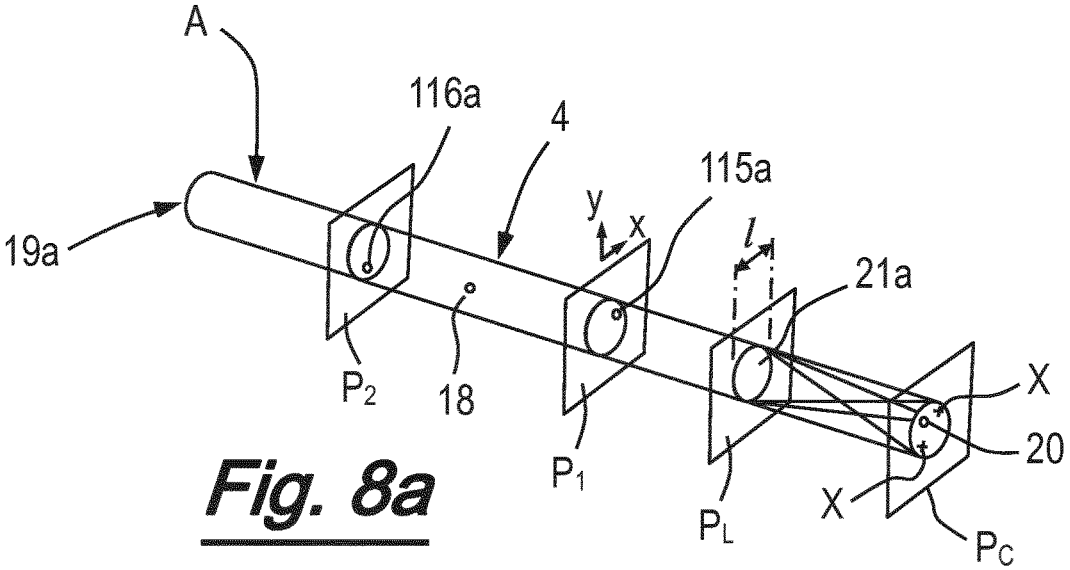
FIG. 8*a* schematically depicts an example of markers in the path of a beam.

FIG. 8*a* shows another example embodiment of markers in the path of the illumination beam A from the backlight 19*a* to the camera 10*a*. Various planes are indicated in FIG. 8: $P_1$ indicates a plane in which a marker 115*a* nearest to the camera is located; $P_2$ indicates a plane in which a marker 116*a* furthest from the camera is located; $P_L$ indicates a plane in which a lens is located and $P_C$ indicates the image plane of the photosensor of camera 10*a*, or of a photosensor proper. In FIG. 8*a*, the marker 115*a* corresponds to the marker 15*a* introduced earlier and the marker 116*a* corresponds to the marker 16*a* introduced earlier In the embodiment of FIG. 8*a*, the markers 115*a* and 116*a* include an opaque square of dimensions d×d. Alternatively, the markers 115*a* and 116*a* may include an opaque circle having a diameter D. In an embodiment, d may e.g. be in the range of 20 μm to 400 μm. In an embodiment, D may be in the range of 2 to 7 mm. The square or circular markers 115*a*, 116*a* may be printed, painted or otherwise affixed onto a plate positioned within the path of the light beam A (or: illumination beam A) at a desired angle, the plate being substantially transparent to the light of light beam A. The plate is, for example, a glass plate or a plate made from crystalline material. Alternatively, the markers 115*a*, 116*a* may be suspended between a plurality of thin wires. The thickness of the wires is preferably considerably less than dimension d and the angle of the wires with respect to the path of propagation of the light beam A may or may not be aligned with the edges of the marker. It may be desirable to choose a thickness and angle of wire which causes the least distortion of the image received at the camera 10*a*.

Figure 8B:
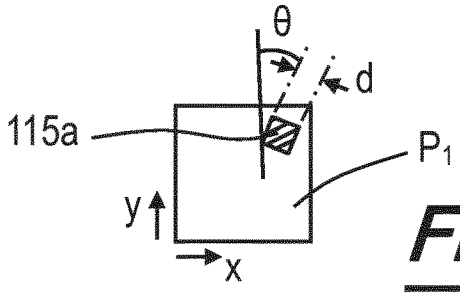
FIG. 8*b* schematically depicts a plane from FIG. 8*a;*

FIG. 8*b* shows a view of the plane $P_1$ from FIG. 8*a*. It can be seen that the marker 115*a* is oriented at an angle θ with respect to the depicted y-axis. The marker 116*a* located in the plane $P_2$ may be oriented at a different angle (i.e. not at angle θ) so that the two markers 115*a*, 116*a* do not obscure one another in the path of the beam A. Alternatively, the markers 115*a*, 116*a* may be oriented at the same angle with respect to the depicted y-axis. In this case, it may be desirable to adjust the relative positions of the markers 115*a*, 116*a* so that the respective diffraction patterns thereof do no overlap with one another.

Figure 8C:
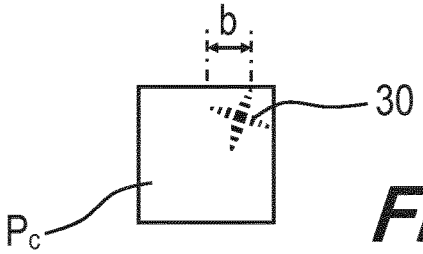
FIG. 8*c* schematically depicts another plane from FIG. 8*a*.

The lens of lens plane $P_L$ is arranged to create a focused image of the fuel target on the image plane $P_C$ of the camera. The markers 115*a*, 116*a* may be out of focus since they are arranged at different distances from the lens than the fuel target. As a result, the markers 115*a*, 116*a* each create a diffraction pattern in the lens plane $P_L$ and the image plane $P_C$ of the camera. The diffraction pattern from an out-of-focus square marker 115*a*, 116*a* will take roughly the shape of a cross. That is, the maxima of the diffraction pattern lie within an area similar to the area of a cross. FIG. 8*c* shows a view of the image plane $P_C$ of the camera 10*a*. A diffraction pattern 30 of the marker 115*a* can be seen in FIG. 8*c*. Even if an image of the marker 115*a* and its diffraction pattern 30 is out of focus, the width of the two lines making up the cross shape of the diffraction pattern 30 will be comparable to the size of the marker 115*a*, thereby making it possible to find the x- and y-coordinates of the marker 115*a* with much higher precision than what might be expected based on an overall size b of the diffraction pattern 30.

Figure 8D:
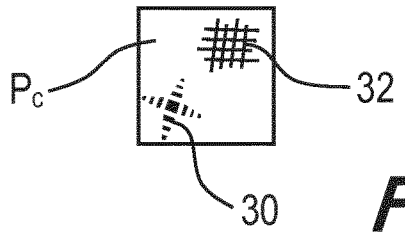
FIG. 8*d* schematically depicts a further plane from FIG. 8*a*.

The camera 10*a* (or the photodetector 10*a*) may have a detector grid 32 formed of individual pixels (or photosites), as illustrated in FIG. 8*d*. By orienting a marker at an angle (for example of between 5 and 20 degrees) relative to the y-axis of the pixel grid 32, it may be possible to achieve sub-pixel accuracy in determining the x- and y-coordinates of the center of the cross shape of the diffraction pattern 30. It will be understood by the skilled person that the position and orientation of the markers 115*a*, 115*b* should be chosen such that the diffraction pattern of the two arms forming the cross 30 does not overlap with the shadow image of the fuel target.

It may be desirable to ensure that the diffraction pattern formed by the markers 115*a*, 116*a* fits inside the lens aperture (dimension l in FIG. 8*a*). The size b of the diffraction pattern from a particular square marker can be approximated using the following equation:

$$b = L\frac{\lambda}{d},$$

where L is the distance between the particular marker and the lens in the lens plane $P_L$, $\lambda$ is the wavelength of the light emitted by the backlight and d is the length of one side of the particular square marker. By way of example, d may be chosen to be in the range from 10 μm to 100 μm. The shorter the length d, the higher the achievable resolution in the image of the marker. In the case of a shorter length d, it may be desirable to provide a relatively larger lens. Since a shorter length d leads to a larger diffraction pattern b, a relatively larger lens makes it possible to capture more or all of the larger diffraction pattern b. The longer the length d, the better the contrast between the diffraction pattern and background light levels.

In other embodiments, one or more of the markers may comprise an opaque plate with a small square aperture having dimensions d'×d'. This will make it possible to select a length d' which is substantially shorter than d because the decreased background light may make the diffraction pattern, obtained when using an opaque plate with a small square aperture, easier to detect than the diffraction pattern obtained from a small opaque marker on a transparent plate. In this case, it may be desirable to increase the diameter of the backlight beam A in order to avoid the diffraction pattern of the opaque plate interfering with the diffraction pattern from the fuel target. This may also entail moving the markers further away from an optical axis of the backlight beam so that they do not occlude the beam to an excessive degree.

In the above, markers have been illustrated as structures protruding from the outer portion 5*b*. One could think of alternative embodiments of the markers as, e.g., structures piercing through the outer portion or as simply holes in the outer portion 5*b*. What is relevant here is that an imaging system is arranged in such a manner that a droplet and one or more markers are simultaneously present in the field of view of the imaging system. A structure piercing through the outer portion 5*b* may enable adjusting the height of the structure relative to the outer portion 5*b* so as to optimize the structure's presence in the field of view.

In an embodiment, the invention may form part of a mask inspection apparatus. The mask inspection apparatus may use EUV radiation to illuminate a mask and use an imaging sensor to monitor radiation reflected from the mask. Images received by the imaging sensor are used to determine whether or not defects are present in the mask. The mask inspection apparatus may include optics (e.g. minors) configured to receive EUV radiation from an EUV radiation source and form it into a radiation beam to be directed at a mask. The mask inspection apparatus may further include optics (e.g. mirrors) configured to collect EUV radiation reflected from the mask and form an image of the mask at the imaging sensor. The mask inspection apparatus may include a processor configured to analyze the image of the mask at the imaging sensor, and to determine from that analysis whether any defects are present on the mask. The processor may further be configured to determine whether a detected mask defect will cause an unacceptable defect in images projected onto a substrate when the mask is used by a lithographic apparatus.

In an embodiment, the invention may form part of a metrology apparatus. The metrology apparatus may be used to measure alignment of a projected pattern formed in resist on a substrate relative to a pattern already present on the substrate. This measurement of relative alignment may be referred to as overlay. The metrology apparatus may for example be located immediately adjacent to a lithographic apparatus and may be used to measure the overlay before the substrate (and the resist) has been processed.

Although specific reference may be made in this text to embodiments of the invention in the context of a lithographic apparatus, embodiments of the invention may be used in other apparatus. Embodiments of the invention may form part of a mask inspection apparatus, a metrology apparatus, or any apparatus that measures or processes an object such as a wafer (or other substrate) or mask (or other patterning device). These apparatuses may be generally referred to as lithographic tools. Such a lithographic tool may use vacuum conditions or ambient (non-vacuum) conditions.

The term "EUV radiation" may be considered to encompass electromagnetic radiation having a wavelength within the range of 4-20 nm, for example within the range of 13-14 nm. EUV radiation may have a wavelength of less than 10 nm, for example within the range of 4-10 nm such as 6.7 nm or 6.8 nm.

Although FIGS. 1 and 2 depict the radiation source SO as a laser produced plasma LPP source, any suitable source may be used to generate EUV radiation. For example, EUV emitting plasma may be produced by using an electrical discharge to convert fuel (e.g. tin) to a plasma state. A radiation source of this type may be referred to as a discharge produced plasma (DPP) source. The electrical discharge may be generated by a power supply which may form part of the radiation source or may be a separate entity that is connected via an electrical connection to the radiation source SO.

For completeness, it is remarked here that what has been explained with reference to a particular one of the imaging system and the further imaging system, may be applicable as well to the other one of the imaging system and the further imaging system.

Although specific reference may be made in this text to the use of lithographic apparatus in the manufacture of ICs, it should be understood that the lithographic apparatus described herein may have other applications. Possible other applications include the manufacture of integrated optical systems, guidance and detection patterns for magnetic domain memories, flat-panel displays, liquid-crystal displays (LCDs), thin-film magnetic heads, etc.

Embodiments of the invention may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g. carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing the firmware, software, routines, instructions, etc.

While specific embodiments of the invention have been described above, it will be appreciated that the invention may be practiced otherwise than as described. The descriptions above are intended to be illustrative, not limiting. Thus it will be apparent to one skilled in the art that modifications may be made to the invention as described without departing from the scope of the claims set out below.

The invention claimed is:

1. A radiation source, comprising:

an emitter configured to emit a fuel target towards a plasma formation region;

a laser system configured to hit the fuel target with a laser beam for generating a plasma at the plasma formation region;

a collector arranged to collect radiation emitted by the plasma;

an imaging system configured to capture an image of the fuel target;

a marker at the collector and within a field of view of the imaging system; and a controller configured to:

receive data representative of the image and location of the marker; and control operation of the radiation source in dependence on the data.

2. The radiation source of claim 1, comprising a second marker at the collector and within the field of view of the imaging system.

3. The radiation source of claim 1, wherein:

the imaging system comprises a first imaging device, a second imaging device, a beam-splitting system and a backlight;

the backlight is configured for illuminating the fuel target and the marker with an illumination beam; and the beam-splitting system is configured to:

receive a first part of the illumination beam, affected by the fuel target;

receive a second part of the illumination beam, affected by the marker;

direct the first part to the first imaging device; and direct the second part to the second imaging device.

4. The radiation source of claim 3, wherein:

the radiation source comprises a second marker at the collector and within the field of view of the imaging system;

the imaging system comprises a third imaging device;

the backlight is configured to illuminate the second marker with the illumination beam; and the beam-splitting system is configured to:

receive a third part of the illumination beam affected by the second marker; and direct the third part to the third imaging device.

5. The radiation source of claim 1, comprising:

a further imaging system configured to capture a further image of the fuel target; and a further marker at the collector and within a further field of view of the further imaging system, wherein:

the imaging system is configured to capture the image of the fuel target from a pre-determined perspective;

the further imaging system is configured to capture the further image of the fuel target from a pre-determined further perspective different from the pre-determined perspective; and the controller is configured to:

receive further data representative of the further image; and control operation of the radiation source in dependence on the further data.

6. The radiation source of claim 5, comprising a second further marker at the collector and within the further field of view of the further imaging system.

7. The radiation source of claim 1, wherein the controller is configured to process the data to determine a position of the fuel target relative to the collector.

8. The radiation source of claim 7, wherein the controller is configured to control at least one of: a trajectory of the fuel target; a position of the laser beam; a direction of the laser beam; a position of the collector; and an orientation of an optical axis of the collector.

9. The radiation source of claim 3, wherein the marker comprises a body substantially opaque to the illumination beam radiation illuminating the body.

10. The radiation source of claim 4, wherein the second marker comprises a second body substantially opaque to the illumination beam illuminating the second body.

11. The radiation source of claim 9, wherein the body has an aperture for letting through part of the illumination beam illuminating the body.

12. The radiation source of claim 10, wherein the second body has a second aperture for letting through a second part of the illumination beam illuminating the second body.

13. The radiation source of claim 3, wherein the marker comprises a crosshair.

14. The radiation source of claim 4, wherein the second marker comprises a second crosshair.

15. The radiation source of claim 3, wherein:

the first part has a first characteristic;

the second part has a second characteristic, different from the first characteristic; and the beam-splitting system is configured to discriminate between the first part and the second part under control of the first characteristic and the second characteristic.

16. The radiation source of claim 15, wherein the first characteristic and the second characteristic, respectively, are characterized by at least one of the following:

a first wavelength of illumination radiation of the illumination beam and a second wavelength of the illumination radiation, respectively;

a first polarization of the illumination radiation and a second polarization of the illumination radiation, respectively; and a first location of incidence on the beam-splitting system and a second location of incidence on the beam-splitting system, respectively.

17. The radiation source of claim 4, wherein:

the first part has a first characteristic;

the second part has a second characteristic, different from the first characteristic;

the third part has a third characteristic, different from the first characteristic and from the second characteristic; and the beam-splitting system is configured to discriminate between the first part, the second part and the third part under control of the first characteristic, the second characteristic and the third characteristic.

18. The radiation source of claim 17, wherein the first characteristic, the second characteristic and the third characteristic respectively, are characterized by at least one of the following:

a first wavelength of illumination radiation of the illumination beam, a second wavelength of the illumination radiation, and a third wavelength of illumination radiation, respectively; and a first location of incidence on the beam-splitting system, a second location of incidence on the beam-splitting system and a third location of incidence on the beam-splitting system, respectively.

19. A combination comprising an emitter, a collector, an imaging system, and a marker at the collector, the combination being configured for use in the radiation source of claim 1.

20. A collector configured for use in the radiation source of claim 1.

* * * * *